US005944554A

United States Patent [19]

Armand et al.

[11] Patent Number: 5,944,554

[45] Date of Patent: Aug. 31, 1999

[54] ELECTRICAL CONNECTOR FOR FLAT FLEXIBLE CIRCUITS

[75] Inventors: Jannick Armand, Lauterbourg, France; Frank Busse, Ettlingen, Germany; Alexander Popa, Karlsbad, Germany; Dirk Reifel, Stutensee, Germany; Uwe Schwarz, Ettlingen, Germany

[73] Assignee: Molex Incorporated, Lisle, Ill.

[21] Appl. No.: 09/045,561

[22] Filed: Mar. 20, 1998

[51] Int. Cl.[6] ..... H01R 9/07

[52] U.S. Cl. ..... 439/499; 439/449

[58] Field of Search ..... 439/499, 492, 439/260, 494, 449

[56] References Cited

U.S. PATENT DOCUMENTS

| | | | |
|---|---|---|---|
| 3,149,896 | 9/1964 | Hall | 339/75 |
| 3,920,301 | 11/1975 | Roberts et al. | 339/17 F |
| 3,994,554 | 11/1976 | Navarro | 439/406 |
| 4,252,396 | 2/1981 | Wilson | 439/405 |
| 4,323,295 | 4/1982 | Davis, Jr. | 439/465 |
| 4,932,895 | 6/1990 | Kerkhof | 439/417 |
| 5,158,479 | 10/1992 | Mouissie | 439/589 |
| 5,384,435 | 1/1995 | Fuerst et al. | 174/262 |
| 5,727,971 | 3/1998 | Junkins et al. | 439/610 |

*Primary Examiner*—Neil Abrams
*Assistant Examiner*—Michael C. Zarroli
*Attorney, Agent, or Firm*—Stacey E. Caldwell

[57] ABSTRACT

An electrical connector is provided for terminating a flat flexible circuit which has at least one pin-receiving hole therein. The connector includes a dielectric housing. At least one conductive terminal is mounted on the housing and includes a projecting pin portion exposed on the housing. A circuit carrier is provided for receiving the flat flexible circuit. The carrier is mountable on the housing in a position for aligning the pin-receiving hole in the circuit with the pin portion of the terminal.

30 Claims, 6 Drawing Sheets

ELECTRICAL CONNECTOR FOR FLAT FLEXIBLE CIRCUITS

FIELD OF THE INVENTION

This invention generally relates to the art of electrical connectors and, particularly, to a connector or electronic device for terminating a flat flexible circuit.

BACKGROUND OF THE INVENTION

A variety of electrical connecting devices are designed for utilization with a flat flexible circuit which may be mounted directly in circuit with terminal pins, for instance. Generally, a flat flexible circuit includes a flat flexible dielectric substrate having one or more holes therein for receiving one or more terminal pins. A ductile conductive film or other circuit trace system is deposited on the substrate in an area at least about the hole or holes. The terminal pins are inserted into the holes in the substrate to establish electrical and mechanical connections between the pins and the flat flexible circuit. Normally, each hole is smaller in diameter than a respective pin. Alternatively, the pin may be punched through the flat flexible circuit to establish the electrical and mechanical connection therewith.

One of the problems with connecting devices as described above is that the flexible circuit is difficult to manipulate and assemble in the connector in order to properly locate the holes in the circuit with the terminal pins. If attempts are made to insert the terminal pins in misaligned holes, the circuit and/or pins can be damaged or, at least, the embracing interface of the circuit about the pins becomes torn, enlarged or otherwise damaged. Another problem involves damage to the circuit after it is properly assembled in the connecting device. If extraneous pulling forces, for instance, are exerted on the flexible circuit, the interface area of the circuit about the terminal pins can be torn, enlarged or otherwise damaged which, in turn, results in inferior or incomplete connections between the terminal pins and the conductive film or other circuit trace on the flexible circuit. The present invention is directed to solving these and other problems involved with electrical connecting devices for flexible circuits or substrates.

SUMMARY OF THE INVENTION

An object, therefore, of the invention is to provide a new and improved electrical connector for a flat flexible circuit.

In the exemplary embodiment of the invention, the connector includes a dielectric housing. At least one terminal is mounted on the housing and includes a projecting pin portion exposed on the housing. A circuit carrier is provided for receiving the flat flexible circuit and is mountable on the housing in a position for aligning a pin-receiving hole in the circuit with the pin portion of the terminal.

As disclosed herein, the circuit carrier includes a hole for receiving the pin portion of the terminal in alignment with the pin-receiving hole in the circuit. The hole in the circuit carrier is sized to receive the pin portion of the terminal. The circuit carrier includes a slot for receiving the flat flexible circuit, with the hole in the carrier communicating with the slot. The circuit carrier includes a second hole on an opposite side of the slot in alignment with the hole in the carrier for receiving a distal end of the pin portion of the terminal. Preferably, the hole in the carrier on the one side of the slot includes an outwardly flared mouth for guiding the distal end of the pin portion of the terminal into the hole.

A feature of the invention includes complementary interengaging latch means between the housing and the circuit carrier. The latch means mounts the carrier in a preload position on the housing allowing assembly of the circuit in the carrier. The carrier is movable from the preload position to a final terminating position with the pin portion of the terminal inserted into the hole in the circuit.

Another feature of the invention includes providing the terminal with a flexible portion. Specifically, the circuit carrier is fixedly engageable with a fixed portion of the terminal. The terminal includes a spring portion free of the carrier to allow for lost motion between the terminal and the housing and, thereby, between the housing and the carrier. As disclosed herein, the fixed portion of the terminal comprises the pin portion thereof.

A further feature of the invention is the provision of strain relief means on the circuit carrier for engaging the flat flexible circuit remote from the pin-receiving hole to, thereby, isolate extraneous pulling forces on the circuit from the interface area between the pin portion of the terminal and the hole. The strain relief means comprise at least one peg extending from the circuit carrier through a second hole in the circuit remote from the pin-receiving hole.

Alternatively, strain relief means may be provided on the housing for engaging the flat flexible circuit remote from the pin-receiving hole to, thereby, isolated extraneous pulling forces on the circuit from the interface area between the pin portion of the terminal and the hole. Specifically, this strain relief means comprises at least one post extending from the housing through a second hole in the circuit remote from the pin-receiving hole. The invention uniquely contemplates that the distance between the second hole and the pin-receiving hole in the flat flexible circuit to be greater than the distance between the post and the pin portion of the terminal to cause the circuit to flexibly waffle between the post and the pin portion and, thereby, compensate for any elongation of the circuit.

Finally, the invention contemplates that the pin-receiving hole in the flat flexible circuit to be generally round. The cross-dimension of the pin portion of the terminal is greater than the diameter of the round hole. The difference between the cross-dimension of the pin portion and the diameter of the round hole is on the order of 5% to 50% of the diameter of the hole.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE REFERRED EMBODIMENTS

Figure 1:
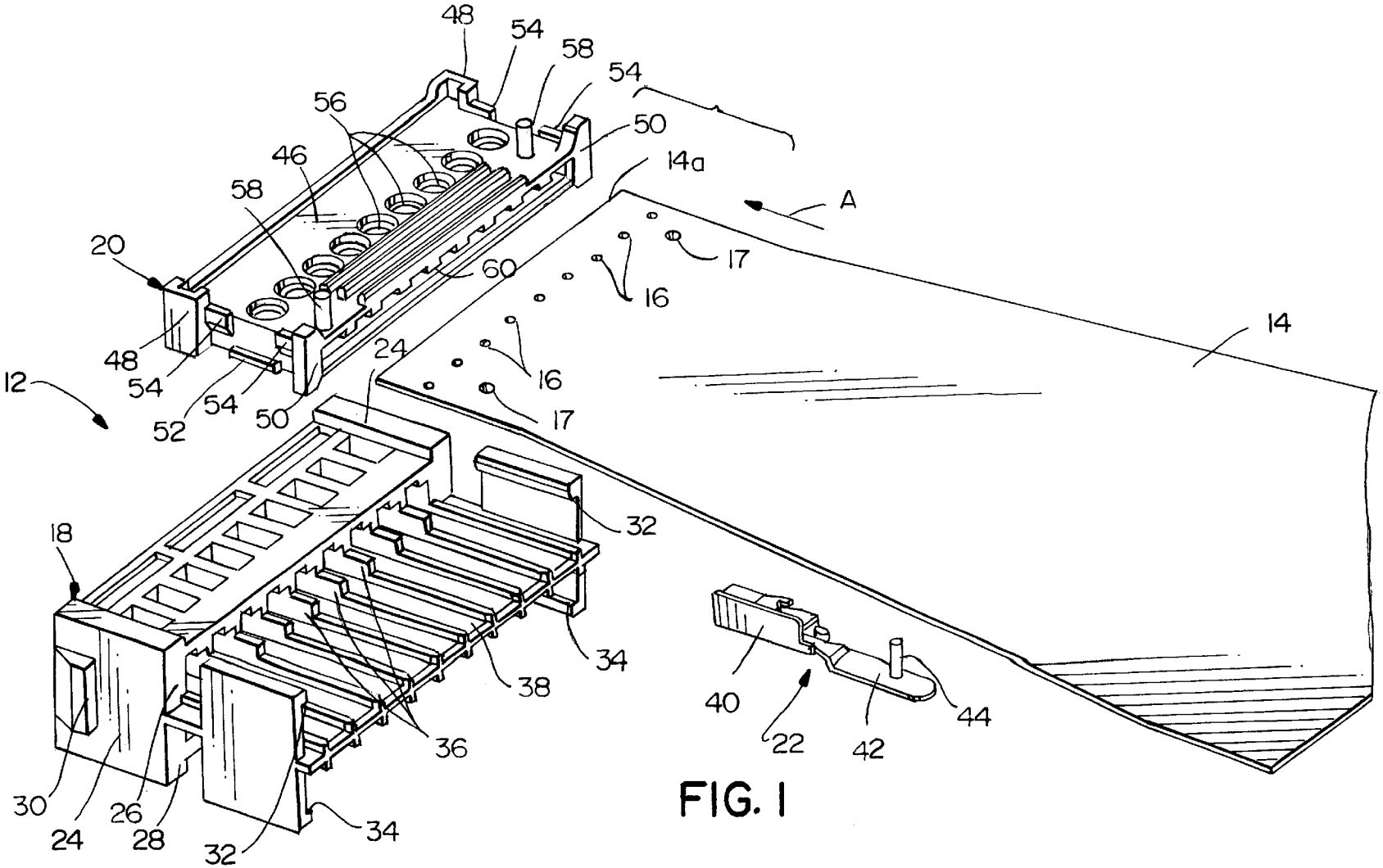
FIG. 1 is an exploded perspective view of an electrical connector embodying the concepts of the invention, in conjunction with a flat flexible circuit.

Referring to the drawings in greater detail, and first to FIG. 1, the invention is embodied in an electrical connector, generally designated 12, for a flat flexible circuit 14 which has at least one pin-receiving hole 16 therein. In the preferred embodiment, a row of pin-receiving holes 16 extend laterally across the flexible circuit spaced inwardly from a leading edge 14*a* of the circuit. A pair of strain relief holes 17 are spaced inwardly of pin-receiving holes 16.

At this point, it should be understood that flat flexible circuit 14 is generally conventional and includes a flat flexible dielectric substrate having pin-receiving holes 16 and strain relief holes 17 therein. A ductile conductive film is deposited on the substrate in an area at least about the holes. As will be seen hereinafter, terminal pins are inserted through the holes from the bottom of the flat flexible circuit as viewed in FIG. 1. Therefore, the ductile conductive film is deposited on the bottom of the circuit substrate as viewed in FIG. 1. Finally, the ductile conductive film does not have to necessarily cover the entire flexible substrate, but the film may define circuit traces having portions surrounding pin-receiving holes 16.

Still referring to FIG. 1, electrical connector 12 includes two main components, namely a dielectric housing, generally designated 18, and a dielectric circuit carrier, generally designated 20, along with a plurality of conductive terminals, generally designated 22. In order to avoid cluttering the drawing, only one terminal is shown.

Dielectric housing 18 of connector 12 is a one-piece structure unitarily molded of dielectric material such as plastic or the like. The housing includes opposite side walls 24 having upper and lower guide grooves 26 and 28, respectively, formed therein. A pair of chamfered latch bosses 30 project outwardly of the side walls for engaging latch means of a complementary mating connecting device (not shown). Each side wall 24 also includes an upper latching lip 32 and a lower latching lip 34 which project inwardly from the respective side wall. Finally, a row of terminal-receiving passages or channels 36 are formed on each opposite side of a transverse, centrally located partition 38 of the housing.

Each terminal 22 includes a forward mating portion 40 and a rear terminating portion 42. Forward mating portion 40 can be of a variety of configurations, but, in the exemplary embodiment, the mating portion defines a generally box-shaped female portion, socket or receptacle for receiving a male terminal of the complementary mating connecting device. Rear terminating portion 42 is a flat blade having a terminal pin 44 projecting therefrom. When the terminal is inserted into a respective one of the terminal-receiving passages 38 of housing 18, the forward mating portion 40 is inserted within the housing, and terminal pin 44 is exposed rearwardly of the housing and projects generally transversely away from partition 38 of the housing. Of course, one of the terminals 22 is inserted into each of the terminal-receiving passages 36 of connector housing 18.

At this point, it can be understood from the above description of housing 18 that the housing is divided into upper and lower halves on opposite sides of partition 38. In other words, upper guide grooves 26, upper latching lips 32 and one row of terminal-receiving passages 36 are formed on the top of partition 38, and, similarly, lower guide grooves 28, lower latching lips 34 and another row of terminal-receiving passages 36 are formed on the bottom of partition 38. This allows for the connector to terminate two flat flexible circuits 14 on opposite sides of partition 38, by using two circuit carriers 20. However, it should be understood that only one of the circuit carriers 20 and one of the flexible circuits 14 will be described hereinafter in conjunction with housing 18, it being understood that the concepts of the invention are equally applicable when the housing is used in conjunction with two circuit carriers and two circuits.

With that understanding, each circuit carrier 20 of connector 12 includes a generally planar body 46 having vertical guide ribs 48 at opposite ends thereof. An additional pair of guide ribs 50 are formed at the rear corners of body 46. A preload latch boss 52 and a pair of final latch bosses 54 project outwardly from each opposite side of body 46 between guide ribs 48 and 50. A row of upper holes 56 are visible in FIG. 1, through body 46. A pair of strain relief pegs 58 project upwardly from body 46. Finally, a circuit-receiving slot 60 is formed in body 46 for receiving flat flexible circuit 14 in the direction of arrow "A". Circuit carrier 20 is a one-piece structure unitarily molded of dielectric material such as plastic or the like.

Figure 2:
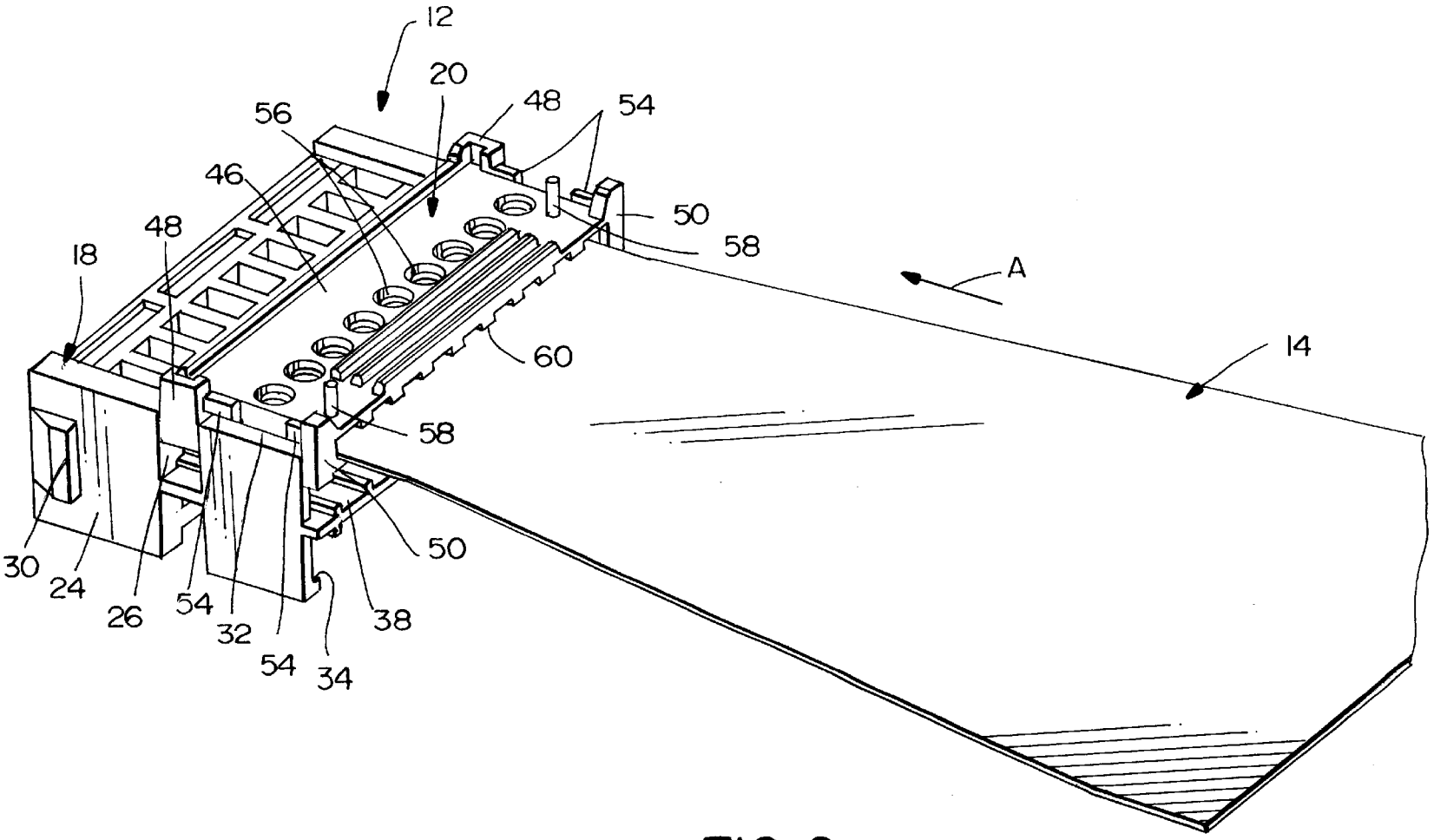
FIG. 2 is a perspective view of the connector receiving the circuit, with the connector in a preload position.

FIG. 2 shows flat flexible circuit 14 inserted into slot 60 of circuit carrier 20, and with the circuit carrier mounted on connector housing 18 in a preload position. Specifically, upper latching lips 32 which project inwardly from opposite side walls 24 of housing 18 are resiliently snapped between preload latching bosses 52 (FIG. 1) and final latching bosses 54 of the circuit carrier. The preload latching bosses prevent the circuit carrier from being lifted off of the housing, and the final latching bosses 54 prevent the carrier from inadvertently moving to a final terminating position. It also can be seen in FIG. 2 that guide ribs 48 on the circuit carrier are guided into upper guide grooves 26 of the housing, while rear guide ribs 50 slide along rear edges of side walls 24 of the housing. In this preload position of circuit carrier 20, flat flexible circuit 14 is free to be inserted into slot 60 of the carrier in the direction of arrow "A".

Figure 3:
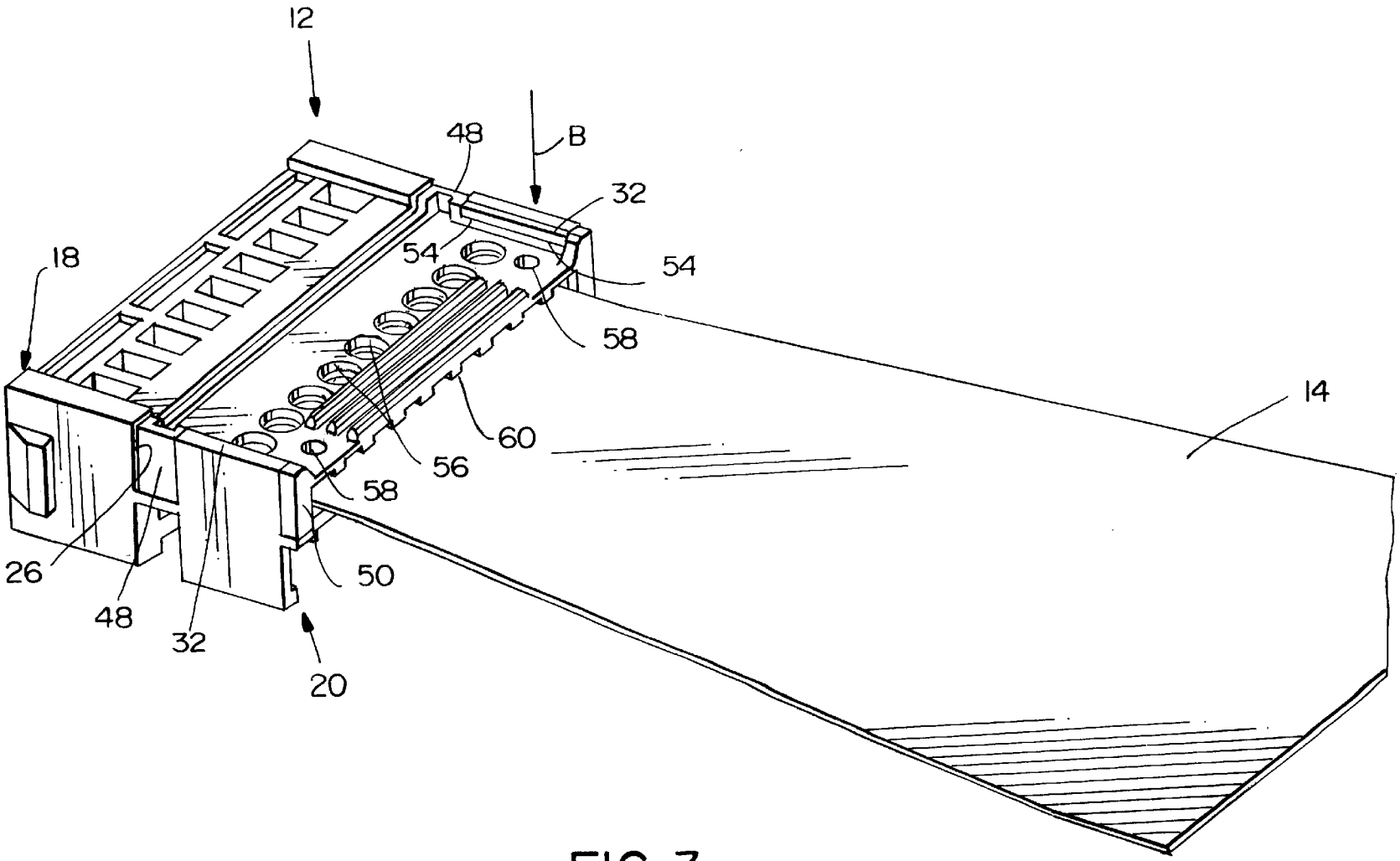
FIG. 3 is a view similar to that of FIG. 2, with the connector in a final terminating position.

FIG. 3 shows circuit carrier 20 having been moved downwardly in the direction of arrow "B" to its final terminating position. It can be seen that latching lips 32 of the carrier have resiliently snapped over the top of final latch bosses 54 of the housing to hold the circuit carrier in its final terminating position. Strain relief pegs 58 also have been forced downwardly through the flexible circuit, as will be described hereinafter.

Figure 4:
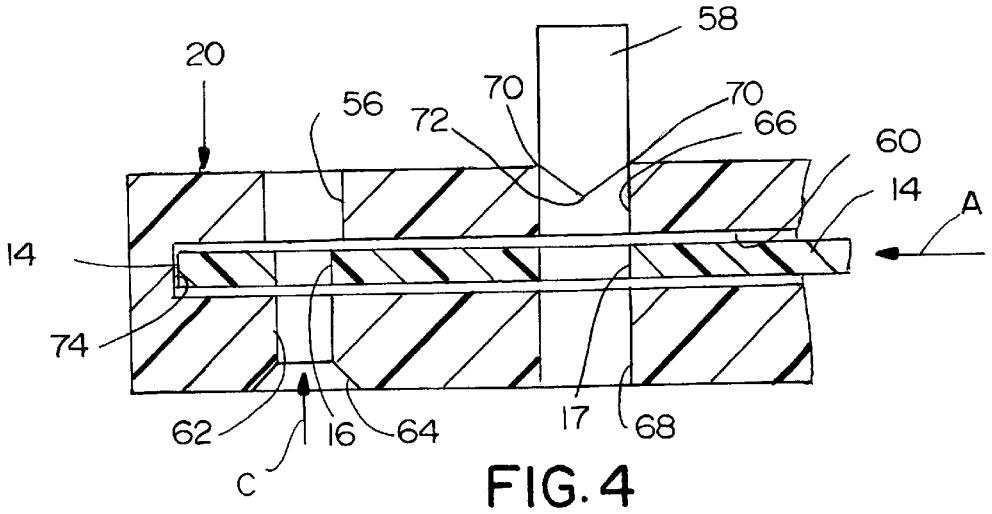
FIG. 4 is a somewhat schematic, fragmented sectional view through the circuit carrier with the circuit loaded therein.
Figure 5:
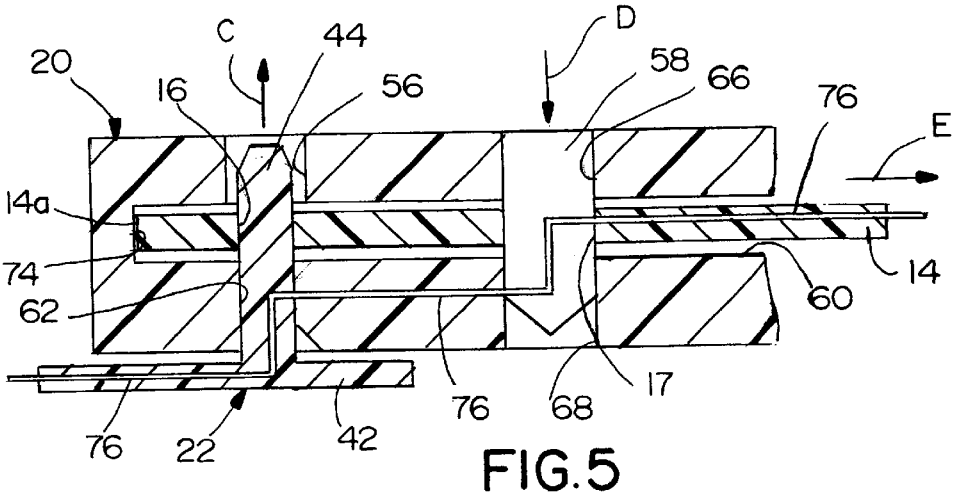
FIG. 5 is a view similar to that of FIG. 4, with the pin portion of the terminal and the strain relief peg of the carrier inserted through the circuit.

FIGS. 4 and 5 show the relative positions of circuit carrier 20, flat flexible circuit 14 and terminal 22, along with terminal pin portion 44, corresponding to the preload and final positions of the connector as described above in relation to FIGS. 2 and 3, respectively. Before proceeding with a description of the terminating operation, it can be seen in FIG. 4 that carrier 20 has a pin-receiving hole 62 beneath slot 60 and in alignment with each top hole 56 described above. The mouth of pin-receiving hole 60 is flared outwardly, as at 64, to facilitate insertion thereinto of pin portion 44 of one of the terminals 22 in the direction of arrow "C". In addition, a top hole 66 and a bottom hole 68 are formed in the circuit carrier on opposite sides of slot 60 in registry with each of the two strain relief pegs 58. with the circuit carrier being molded of plastic material, the strain relief peg may be molded integrally therewith by thin frangible webs, as at 70. The inner end of each strain relief peg 58 is pointed, as at 72, to facilitate insertion of the peg through its respective strain relief hole 17 in the circuit.

In assembly, flat flexible circuit 14 is inserted into slot 60 of circuit carrier 20 in the direction of arrow "A" (FIG. 4) until leading edge 14*a* of the circuit bottoms out against a locating wall 74 at the inner end of the slot. When the circuit is so located, pin-receiving holes 16 in the circuit are aligned with holes 62 in the circuit carrier, and strain relief holes 17 in the circuit are aligned with holes 66 and 68 of the carrier. The circuit can be inserted into the carrier when the carrier is in its preload position as shown in FIG. 2 and described above.

Referring to FIG. 5, when circuit carrier 20 is moved to its final terminating position described above in relation to FIG. 3, pin portions 44 of terminals 22 move through holes 62 in the direction of arrow "C" (FIG. 5), through pin-receiving holes 16 in circuit 14 and into upper holes 56 of the circuit carrier. Holes 62 in the circuit carrier are sized to receive the pin portions of the flexible circuit whereby the circuit cannot move relative to the pin portions to any appreciable extent. To complete the termination, strain relief pegs 58 are broken from the plastic carrier and are forced downwardly in the direction of arrow "D" (FIG. S) through holes 17 in the flexible circuit, with an interference fit within the holes. For illustration purposes, FIG. 5 shows a dark line 76 which defines the force path of any extraneous pulling forces on the flexible circuit in the direction of arrow "E". These pulling forces are transmitted from the circuit to strain relief pegs 58, from the pegs to circuit carrier 20, and from the carrier to pin portions 44 and, thereby, terminals 22. Therefore, the pulling forces are isolated from the interface area between the flexible circuit and pin portions 44, i.e. about pin-receiving holes 16 of the circuit.

Figure 6:
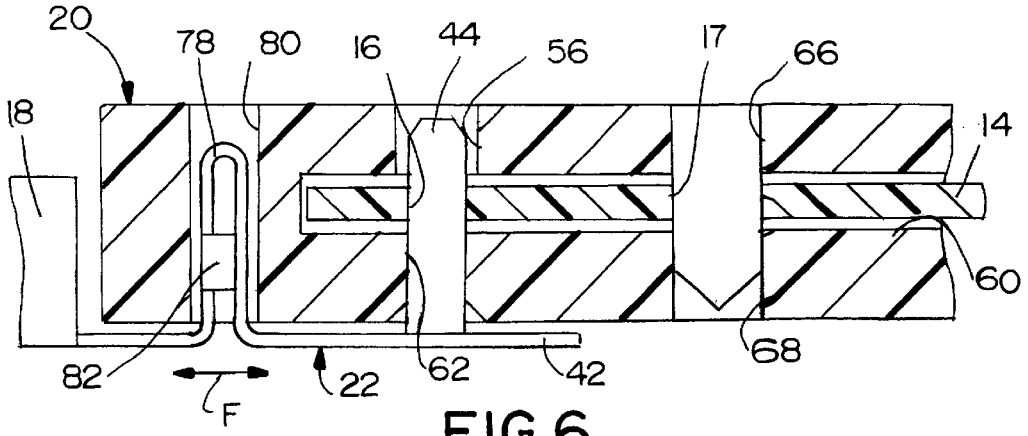
FIG. 6 is a view similar to that of FIG. 5, but of an alternate embodiment wherein the terminal includes a lost motion spring section.
Figure 7:
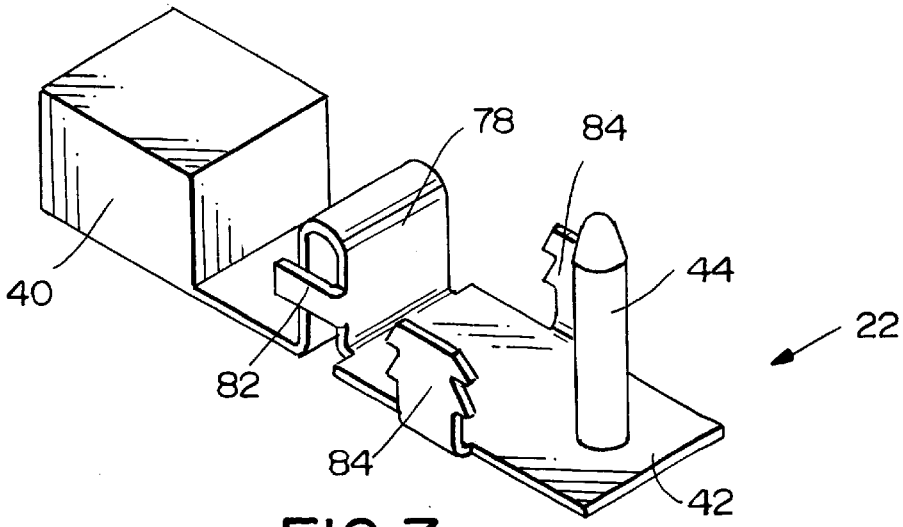
FIG. 7 is a perspective view of an alternative embodiment of a terminal having a retention portion for fixing the terminal to the circuit carrier.

FIGS. 6 and 7 show an alternate embodiment of a terminal which includes a generally U-shaped spring portion 78 which projects upwardly into a passage 80 in circuit carrier 20. This spring portion is disposed freely within passage 80 so as to be able to flex free of the circuit carrier. In essence, the spring portion of the terminal provides a lost motion means between housing 18 and terminal 22 and, thereby, between the circuit carrier and housing 18, i.e. allowing for limited relative movement in the direction of double-headed arrow "F". A side arm 82 may be used to limit the amount of flexing of spring element 78 within passage 80.

FIG. 7 shows that the terminal also may include a retention portion in the form of a pair of toothed barbs 84 for biting into the plastic material of circuit carrier 20. This provides a further strain relief means between the terminal pin portion of the terminal and the circuit carrier.

Figure 8:
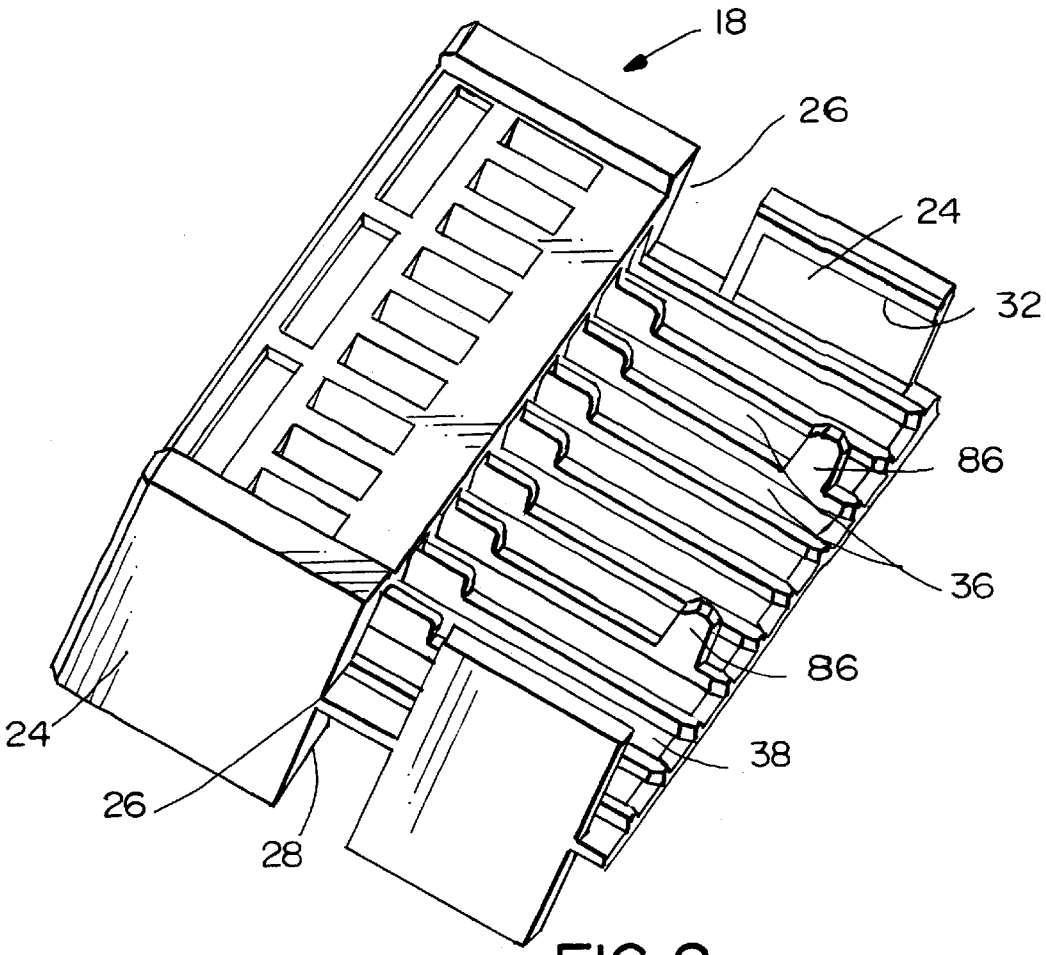
FIG. 8 is a perspective view of an alternative embodiment of the connector housing having a strain relief means for the flexible circuit.
Figure 9:
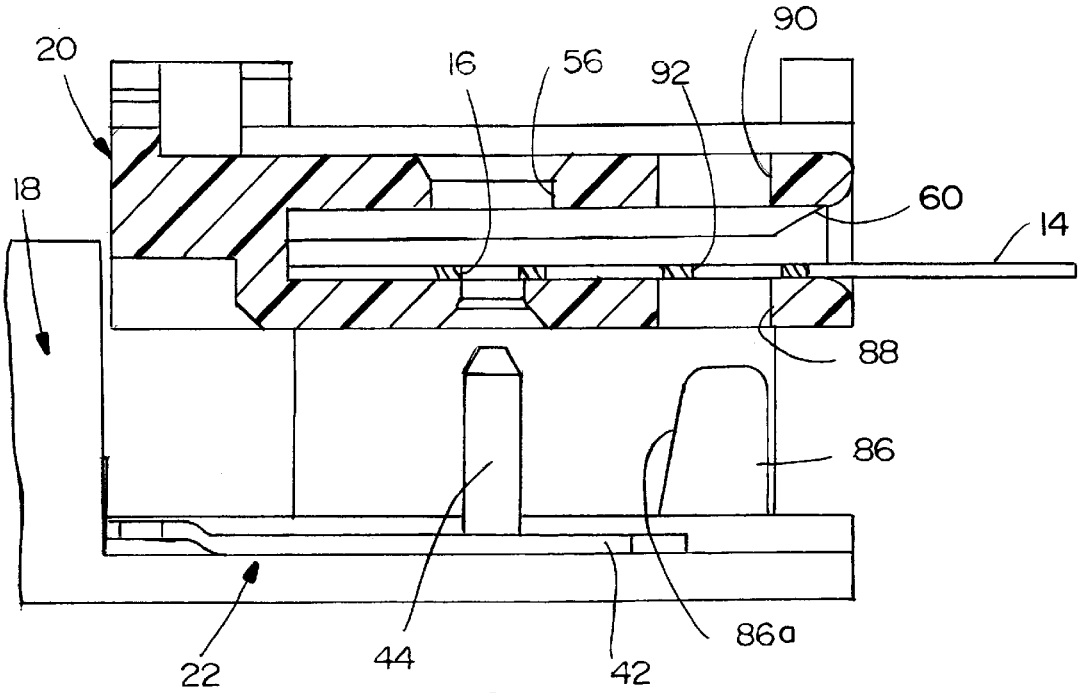
FIG. 9 is a fragmented vertical section through a connector incorporating the housing of FIG. 8, prior to assembling the circuit carrier and circuit to the housing.
Figure 10:
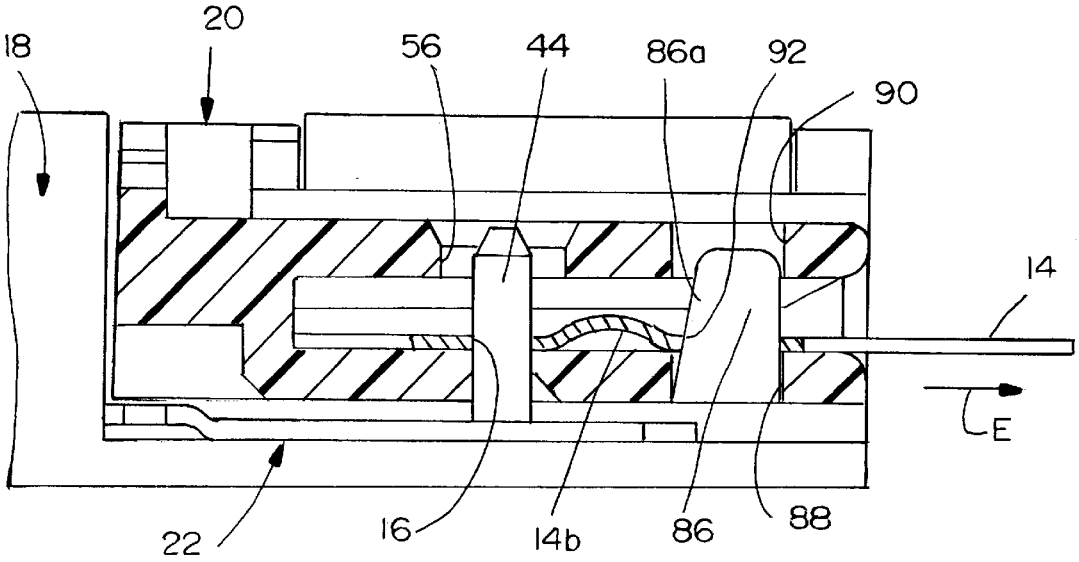
FIG. 10 is a view similar to that of FIG. 9, with the circuit carrier and circuit assembled to the housing.

FIGS. 8–10 show another embodiment of the invention wherein housing 18 includes a pair of strain relief posts 86 which project through lower and upper holes 88 and 90, respectively, on opposite sides of slot 60 in circuit carrier 20. The strain relief posts project through a pair of strain relief holes 92 in flat flexible circuit 14. The strain relief posts are effective to isolate extraneous pulling forces on flexible circuit 14 from the interface area between pin portions 44 of terminals 22 and pin-receiving holes 16 in the flexible circuit.

It can be seen in FIG. 9 that the distance between strain relief holes 92 and pin-receiving holes 16 in the flexible circuit is greater than the distance between strain relief posts 86 and pin portions 44 of the terminals. Therefore, as seen in FIG. 10, when the circuit is terminated, a portion 14*b* of the circuit is cause to flexibly waffle between posts 86 and pin portions 44 and, thereby, compensate for any elongation of the flexible circuit. This ensures that all extraneous pulling forces on the circuit in the direction of arrow "E" will be transmitted to strain relief posts 86 and the housing rather than to terminal pin portions 44 and the interface areas thereabout.

Lastly, the invention contemplates the use of a principle which may be called a "controlled meniscus" in accordance with the teachings of U.S. Pat. No. 5,384,435, dated Jan. 24, 1995 and assigned to the assignee of the present invention. In other words, the substrate of flat flexible circuit 14 may be less than 0.050 inch thick, with pin-receiving holes 16 being generally round and of a given diameter. The cross-dimensions of pin portions 44 are greater than the diameters of the round holes. The difference between the cross-dimensions of pin portions 44 and the diameters of the round pin-receiving holes 16 is on the order of 5% to 50% of the diameters of the holes.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for a flat flexible circuit which has at least one pin-receiving hole therein, comprising:

a dielectric housing;

at least one conductive terminal mounted on the housing and including a projecting pin portion;

a circuit carrier for receiving said flat flexible circuit and being mountable on the housing in a position for aligning the pin-receiving hole in the circuit with the pin portion of said terminal; and complementary interengaging latch means between the housing and the circuit carrier for mounting the carrier in a preload position on the housing allowing assembly of the circuit on the carrier and in a final terminating position with the pin portion of the terminal inserted into the hole in the circuit.

2. The electrical connector of claim 1 wherein said circuit carrier includes a hole for receiving the pin portion of the terminal in alignment with the pin-receiving hole in the circuit.

3. The electrical connector of claim 2 wherein said hole in the circuit carrier is sized to receive the pin portion of the terminal.

4. The electrical connector of claim 3 wherein said circuit carrier includes a slot for receiving the flat flexible circuit, with said hole in the carrier communicating with the slot.

5. The electrical connector of claim 4 wherein said circuit carrier includes a second hole on an opposite side of the slot in alignment with said first hole in the carrier for receiving a distal end of the pin portion of the terminal.

6. The electrical connector of claim 2 wherein said hole includes an outwardly flared mouth for guiding a distal end of the pin portion of the terminal into the hole.

7. The electrical connector of claim 1 wherein said circuit carrier is fixedly engageable with a fixed portion of the terminal, and the terminal includes a spring portion free of the carrier to allow for lost motion between the housing and the terminal and, thereby, between the carrier and the housing.

8. The electrical connector of claim 7 wherein said fixed portion of the terminal comprises said pin portion.

9. The electrical connector of claim 1, including strain relief means on said circuit carrier for engaging the flat flexible circuit remote from the pin-receiving hole to relieve pulling forces on the circuit at the interface area between the pin portion of the terminal and the hole.

10. The electrical connector of claim 9 wherein said strain relief means comprise at least one peg extending from the circuit carrier through a second hole in the circuit remote from the pin-receiving hole.

11. The electrical connector of claim 1, including strain relief means on the housing for engaging the flat flexible circuit remote from the pin-receiving hole to relieve pulling forces on the circuit at the interface area between the pin portion of the terminal and the hole.

12. The electrical connector of claim 11 wherein said strain relief means comprise at least one post extending from the housing through a second hole in the circuit remote from the pin-receiving hole.

13. The electrical connector of claim 12 wherein the distance between said second hole and the pin-receiving hole in the flat flexible circuit is greater than the distance between said post and the pin portion of the terminal.

14. The electrical connector of claim 1, including at least one retention portion on the terminal remote from said pin portion for fixing the terminal to the circuit carrier.

15. In combination with the electrical connector of claim 1, a flat flexible circuit wherein said pin-receiving hole is generally round, the cross-dimension of said pin portion of the terminal being greater than the diameter of the round hole, wherein the difference between the cross-dimension of the pin portion and the diameter of the round hole is between 5% and 50% of the diameter of the hole.

16. An electronic device, comprising:

a flat flexible dielectric substrate less than 0.050 inch thick and having a generally round pin-receiving hole of a given diameter;

a ductile conductive film on the substrate in an area at least about said hole;

a dielectric housing;

a conductive terminal mounted on the housing and including a projecting pin portion insertable into the pin-receiving hole in the substrate, the cross-dimension of the pin portion being greater than the diameter of the round hole;

a circuit carrier for receiving the flat flexible dielectric substrate and being mountable on the housing in a position for aligning the pin-receiving hole in the circuit to receive the pin portion of the terminal; and wherein the difference between the cross-dimension of the pin portion and the diameter of the round hole is between 5% and 50% of the diameter of the hole.

17. The electronic device of claim 16, including complementary interengaging latch means between the housing and the circuit carrier for mounting the carrier in a preload position on the housing allowing assembly of the circuit on the carrier and a final terminating position with the pin portion of the terminal inserted into the hole in the circuit.

18. The electronic device of claim 16 wherein said circuit carrier includes a hole for receiving the pin portion of the terminal in alignment with the pin-receiving hole in the substrate.

19. The electronic device of claim 18 wherein said hole in the circuit carrier is sized to receive the pin portion of the terminal.

20. The electronic device of claim 19 wherein said circuit carrier includes a slot for receiving the flat flexible substrate, wherein said hole in the carrier communicates with the slot.

21. The electronic device of claim 20 wherein said circuit carrier includes a second hole on an opposite side of the slot in alignment with said first hole in the carrier for receiving a distal end of the pin portion of the terminal.

22. The electronic device of claim 18 wherein said hole includes an outwardly flared mouth for guiding a distal end of the pin portion of the terminal into the hole.

23. The electronic device of claim 16 wherein said circuit carrier is fixedly engageable with a fixed portion of the terminal, and the terminal includes a spring portion free of the carrier to allow for lost motion between the housing and the terminal and, thereby, between the carrier and the housing.

24. The electronic device of claim 23 wherein said fixed portion of the terminal comprises said pin portion.

25. The electronic device of claim 16, including strain relief means on said circuit carrier for engaging the flat flexible substrate remote from the pin-receiving hole to relieve extraneous pulling forces on the substrate at the interface area between the pin portion of the terminal and the hole.

26. The electronic device of claim 25 wherein said strain relief means comprise at least one peg extending from the circuit carrier through a second hole in the substrate remote from the pin-receiving hole.

27. The electronic device of claim 16, including strain relief means on the housing for engaging the flat flexible substrate remote from the pin-receiving hole to relieve extraneous pulling forces on the substrate at the interface area between the pin portion of the terminal and the hole.

28. The electronic device of claim 27 wherein said strain relief means comprise at least one post extending from the housing through a second hole in the substrate remote from the pin-receiving hole.

29. The electronic device of claim 28 wherein the distance between said second hole and the pin-receiving hole in the flat flexible substrate is greater than the distance between said post and the pin portion of the terminal.

30. The electronic device of claim 16, including at least one retention portion on the terminal remote from said pin portion for fixing the terminal to the circuit carrier.

* * * * *